US009280125B2

(12) United States Patent
Itoh et al.

(10) Patent No.: US 9,280,125 B2
(45) Date of Patent: Mar. 8, 2016

(54) IMAGE FORMING APPARATUS

(71) Applicants: Wakana Itoh, Kanagawa (JP); Tadashi Kasai, Kanagawa (JP); Takamasa Ozeki, Kanagawa (JP); Jun Hitosugi, Tokyo (JP); Emiko Shiraishi, Tokyo (JP); Makoto Yasuda, Kanagawa (JP); Kunio Hasegawa, Kanagawa (JP); Mutsuki Morinaga, Kanagawa (JP); Takatsugu Komori, Chiba (JP); Hitoshi Yamamoto, Kanagawa (JP)

(72) Inventors: Wakana Itoh, Kanagawa (JP); Tadashi Kasai, Kanagawa (JP); Takamasa Ozeki, Kanagawa (JP); Jun Hitosugi, Tokyo (JP); Emiko Shiraishi, Tokyo (JP); Makoto Yasuda, Kanagawa (JP); Kunio Hasegawa, Kanagawa (JP); Mutsuki Morinaga, Kanagawa (JP); Takatsugu Komori, Chiba (JP); Hitoshi Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/629,970

(22) Filed: Feb. 24, 2015

(65) Prior Publication Data

US 2015/0268618 A1 Sep. 24, 2015

(30) Foreign Application Priority Data

Mar. 18, 2014 (JP) ..... 2014-054433

(51) Int. Cl.
*G03G 21/00* (2006.01)

(52) U.S. Cl.
CPC ..... *G03G 21/0094* (2013.01); *G03G 21/0005* (2013.01); *G03G 21/0011* (2013.01); *G03G 21/0035* (2013.01)

(58) Field of Classification Search
CPC ..... G03G 21/00
USPC ..... 399/346
See application file for complete search history.

(56) References Cited

U.S. PATENT DOCUMENTS

| | | | | |
|---|---|---|---|---|
| 7,970,334 | B2 * | 6/2011 | Yamashita et al. | 399/346 |
| 2004/0076443 | A1 | 4/2004 | Suzuki et al. | |
| 2004/0165919 | A1 * | 8/2004 | Nishida | 399/346 |
| 2006/0210334 | A1 * | 9/2006 | Tokumasu et al. | 399/346 |
| 2008/0089726 | A1 * | 4/2008 | Hatakeyama et al. | 399/346 |
| 2008/0118286 | A1 * | 5/2008 | Yamashita et al. | 399/346 |
| 2009/0003853 | A1 * | 1/2009 | Hatakeyama et al. | 399/34 |
| 2009/0196665 | A1 * | 8/2009 | Tanaka et al. | 399/346 |
| 2009/0279930 | A1 * | 11/2009 | Kabata et al. | 399/346 |
| 2009/0285613 | A1 * | 11/2009 | Nakai et al. | 399/346 |
| 2009/0290919 | A1 | 11/2009 | Tanaka et al. | |
| 2009/0290920 | A1 * | 11/2009 | Hatakeyama et al. | 399/346 |
| 2009/0304423 | A1 * | 12/2009 | Ozaki et al. | 399/346 |
| 2009/0311014 | A1 * | 12/2009 | Tanaka et al. | 399/315 |
| 2010/0034570 | A1 * | 2/2010 | Hatakeyama et al. | 399/346 |
| 2010/0054829 | A1 | 3/2010 | Iio et al. | |
| 2010/0183972 | A1 * | 7/2010 | Hasegawa et al. | 430/119.7 |

(Continued)

FOREIGN PATENT DOCUMENTS

| | | |
|---|---|---|
| JP | 5-119598 | 5/1993 |
| JP | 2005-099127 | 4/2005 |

(Continued)

*Primary Examiner* — Clayton E Laballe
*Assistant Examiner* — Kevin Butler
(74) *Attorney, Agent, or Firm* — Oblon, McClelland, Maier & Neustadt, L.L.P.

(57) ABSTRACT

An image forming apparatus includes a first image bearer, a lubricant dispenser to apply lubricant to the first image bearer, and a controller to adjust a spatial interval during image formation between successive recording media on each of which an image is formed, according to a total amount of toner attached to the first image bearer for each of the successive recording media, to apply the lubricant to the first image bearer.

15 Claims, 5 Drawing Sheets

(56) References Cited

U.S. PATENT DOCUMENTS

| | | | | |
|---|---|---|---|---|
| 2010/0209143 | A1* | 8/2010 | Nakai et al. | 399/123 |
| 2010/0310291 | A1* | 12/2010 | Tanaka et al. | 399/346 |
| 2010/0316422 | A1* | 12/2010 | Amemiya et al. | 399/346 |
| 2011/0008088 | A1* | 1/2011 | Nakai et al. | 399/346 |
| 2011/0085824 | A1* | 4/2011 | Hatakeyama et al. | 399/159 |
| 2011/0129269 | A1* | 6/2011 | Seo et al. | 399/346 |
| 2012/0057912 | A1 | 3/2012 | Hasegawa et al. | |
| 2012/0063825 | A1 | 3/2012 | Hasegawa et al. | |
| 2012/0141177 | A1 | 6/2012 | Urayama et al. | |
| 2012/0195662 | A1 | 8/2012 | Hasegawa et al. | |
| 2012/0315053 | A1* | 12/2012 | Kudo et al. | 399/44 |
| 2012/0321330 | A1 | 12/2012 | Kudo et al. | |
| 2013/0177329 | A1* | 7/2013 | Tanaka et al. | 399/66 |
| 2013/0216286 | A1* | 8/2013 | Hasegawa et al. | 399/346 |
| 2013/0259552 | A1* | 10/2013 | Hasegawa et al. | 399/346 |
| 2013/0315642 | A1 | 11/2013 | Nakai et al. | |
| 2013/0343793 | A1* | 12/2013 | Nishisaka et al. | 399/346 |
| 2014/0030644 | A1* | 1/2014 | Hasegawa et al. | 430/56 |
| 2014/0093294 | A1* | 4/2014 | Komito et al. | 399/346 |
| 2014/0161501 | A1* | 6/2014 | Watanabe et al. | 399/346 |
| 2014/0169851 | A1* | 6/2014 | Saito et al. | 399/346 |
| 2014/0193172 | A1* | 7/2014 | Tawada et al. | 399/111 |

FOREIGN PATENT DOCUMENTS

| | | | | |
|---|---|---|---|---|
| JP | 2005-249917 | | 9/2005 | |
| JP | 2006-194943 | | 7/2006 | |
| JP | 2008-116547 | | 5/2008 | |
| JP | 2011-102946 | | 5/2011 | |
| JP | 2011-145575 | * | 7/2011 | G03G 21/00 |
| JP | 2011-170320 | | 9/2011 | |
| JP | 2012-058517 | * | 3/2012 | G03G 21/00 |

* cited by examiner

IMAGE FORMING APPARATUS

CROSS-REFERENCE TO RELATED APPLICATION

This patent application is based on and claims priority pursuant to 35 U.S.C. §119(a) to Japanese Patent Application No. 2014-054433, filed on Mar. 18, 2014, in the Japan Patent Office, the entire disclosure of which is hereby incorporated by reference herein.

BACKGROUND

1. Technical Field

Embodiments of the present invention generally relate to an image forming apparatus.

2. Background Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium directly, or indirectly via an intermediate transfer belt. Finally, a fixing device applies heat and pressure to the recording medium carrying the toner image to fix the toner image onto the recording medium.

Such image forming apparatuses may incorporate a lubricant dispenser that applies lubricant to an image bearer, to prevent damage to the image bearer and such errors as toner filming.

SUMMARY

In one embodiment of the present invention, an improved image forming apparatus is described that includes a first image bearer, a lubricant dispenser to apply lubricant to the first image bearer, and a controller to adjust a spatial interval during image formation between successive recording media on each of which an image is formed, according to a total amount of toner attached to the first image bearer for each of the successive recording media, to apply the lubricant to the first image bearer.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
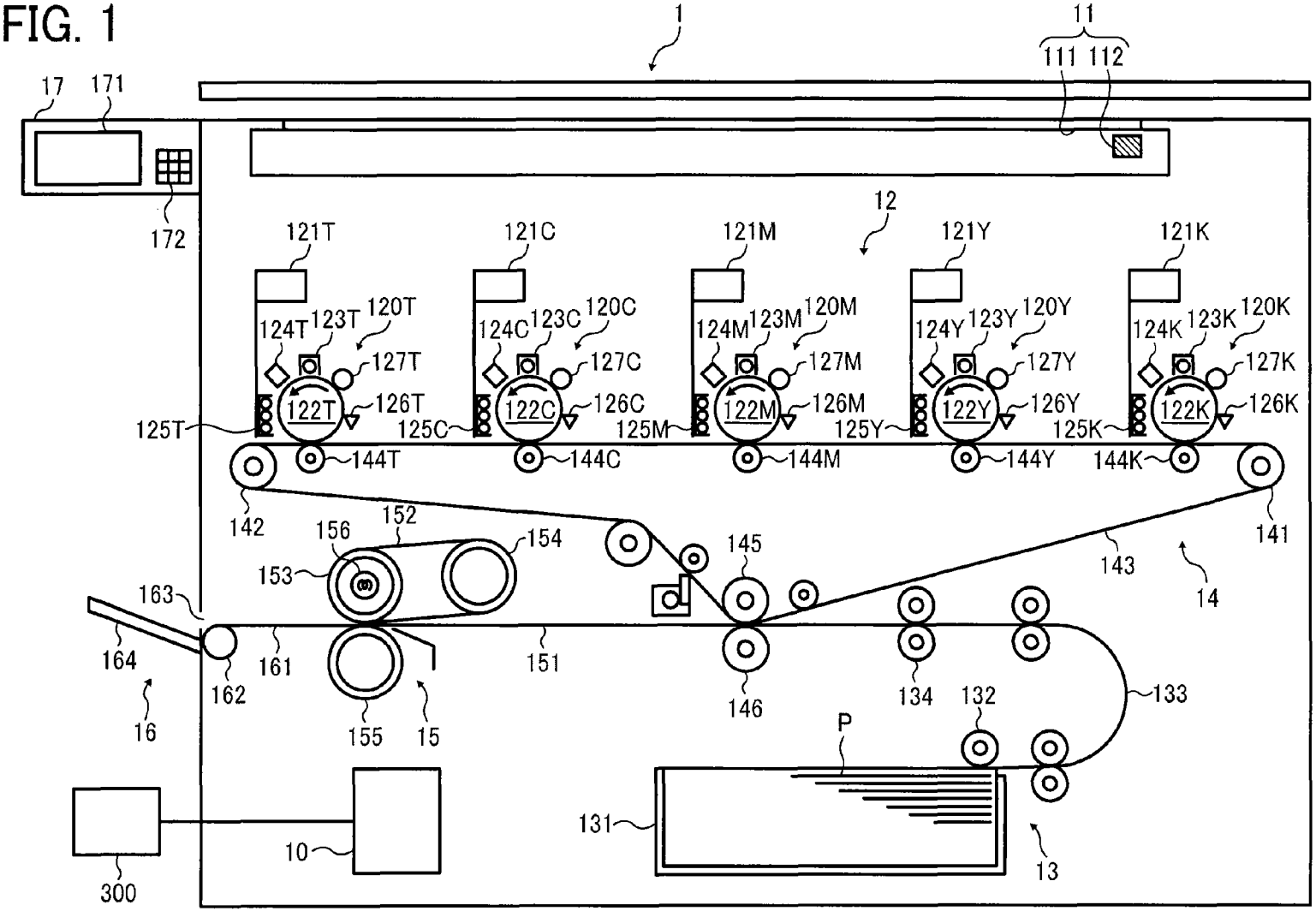
FIG. 1 is a schematic sectional view of an image forming apparatus according to an embodiment of the present invention.

The accompanying drawings are intended to depict embodiments of the present invention and should not be interpreted to limit the scope thereof.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and not all of the components or elements described in the embodiments of the present invention are indispensable.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

It is to be noted that, in the following description, suffixes C, M, Y, K, T, and W denote colors cyan, magenta, yellow, black, clear, and white, respectively. To simplify the description, these suffixes are omitted unless necessary.

Referring now to the drawings, wherein like reference numerals designate identical or corresponding parts throughout the several views, embodiments of the present invention are described below.

Initially with reference to FIG. 1, a description is given of an electrophotographic image forming apparatus 1 according to an embodiment of the present invention. FIG. 1 is a schematic sectional view of the image forming apparatus 1.

In the present embodiment, the image forming apparatus 1 is a multifunction peripheral capable of forming a full-color toner image on a recording medium P.

As illustrated in FIG. 1, the image forming apparatus 1 includes, e.g., a controller 10, an scanner 11, an image forming unit 12, a sheet feeder 13, a transfer unit 14, a fixing device 15, an ejection device 16, and a control panel 17.

According to, e.g., manual operation through the control panel 17, image data and a control signal form an external device 300 such as a computer connected to the image forming apparatus 1 via a network, and a program stored in advance, the controller 10 communicates with, e.g., the above-described components of the image forming apparatus 1 as well as the external device 300 to control operations of the components, to perform data processing, and to input/output data.

Specifically, the controller 10 is implemented as a central processing unit (CPU) provided with, e.g., storages such as a read only memory (ROM) and a random access memory (RAM), integrated circuits (ICs) including large scale integration (LSI) of drivers and/or controllers for the components, and an interface (I/F) that communicates with the components and the external equipment.

According to programs stored in the ROM or the RAM, the CPU performs processing and calculation of data, controls operations of the scanner 11, the image forming unit 12, the sheet feeder 13, the transfer unit 14, the fixing device 15, and the ejection device 16, and communicates with the external equipment.

The scanner 11 optically scans an image of a document to generate image data.

Specifically, the scanner 11 includes, e.g., an exposure glass 111 and a sensor 112 such as a charge coupled device (CCD) or a contact image sensor (CIS). The scanner 11 emits light toward a document bearing an image placed on the exposure glass 111, and receives light reflected from the document with the sensor 112, which reads image data of the document.

The image data is data indicative of an image to be formed on the recording medium P, using red (R), green (G), and blue (B) electrical color separation image signals.

The image forming unit 12 attaches toner to an outer circumferential surface of an intermediate transfer belt 143 of the transfer unit 14 to form a toner image thereon, according to the image data scanned by the scanner 11 or image data received from the external equipment via a network interface.

Specifically, the image forming unit 12 includes five image forming devices 120C, 120M, 120Y, 120K, and 120T to form toner images using cyan (C), magenta (M), yellow (Y), black (K), and clear (T) toner, respectively.

In the following description, the cyan, magenta, yellow, and black toner may be referred to as process color toner, whereas the clear toner may be referred to as spot color toner.

Specifically, the process color toner is constituted of resin particles having electrostatic characteristics of colorants such as pigments or dye. On the other hand, the clear toner is colorless transparent toner constituted of resin particles, which enhances visibility of a part of the recording medium P to which the clear toner is attached or visibility of the process color toner attached to the recording medium P on which the clear toner is superimposed.

The clear toner is generated by, e.g., adding silicon dioxide ($SiO_2$) and titanium dioxide ($TiO_2$) to polyester resin having low molecular weight. It is to be noted that the clear toner may contain colorants provided that the amount of the clear toner is sufficient to enhance visibility of the part of the recording medium P to which the clear toner is attached or to enhance visibility of the process color toner attached to the recording medium P on which the clear toner is superimposed.

A detailed description is now given of the five image forming devices 120C, 120M, 120Y, 120K, and 120T.

As illustrated in FIG. 1, the image forming devices 120C, 120M, 120Y, 120K, and 120T are identical in configuration, differing only in the color of toner employed. Therefore, suffixes C, M, Y, K, and T are omitted in the following description unless necessary.

The image forming device 120 includes a developer container 121, a drum-shaped photoconductor 122, a charger 123, an exposure device 124, a developing device 125, a discharger 126, and a photoconductor cleaner 127.

The developer containers 121C, 121M, 121Y, 121K, and 121T contain toner of cyan, magenta, yellow, black and clear toner, respectively, and supply the toner to the developing devices 125C, 125M, 125Y, 125K, and 125T, respectively. Specifically, when a conveying screw provided in the developer container 121 is driven, a predetermined amount of toner is supplied from the developer container 121 to the developing device 125.

It is to be noted that the image forming device 120T may contain white toner as spot color toner instead of clear toner. In this case, the image forming device 120T may be referred to as image forming device 120W. Specifically, a toner bottle for clear toner included in the developer container 121T is replaceable with a toner bottle of white toner or another toner bottle of another spot color toner. If the developer container 121 contains white toner and referred to as a developer container 121W, use of the developer container 121W is directed through an operation part 172 of the control panel 17 to switch control within the controller 10.

The photoconductor 122 is disposed to contact the intermediate transfer belt 1433. The photoconductor 122 and the intermediate transfer belt 143 rotate in different directions, with the photoconductor 122 rotating counterclockwise and the intermediate transfer belt 143 rotating clockwise.

The charger 123 uniformly charges an outer circumferential surface of the photoconductor 122. The exposure device 124 emits light to the charged surface of the photoconductor 122 according to image data received from the controller 10, specifically, halftone area ratio of the corresponding color determined by the controller 10, thereby forming an electrostatic latent image on the surface of the photoconductor 122.

The developing device 125 develops with toner the electrostatic latent image thus formed on the surface of the photoconductor 122, specifically by attaching toner of the corresponding color contained in the developer container 121 to the electrostatic latent image, thereby forming a visible toner image on the surface of the photoconductor 122.

The discharger 126 discharges the surface of the photoconductor 122 after the toner image is transferred onto the intermediate transfer belt 143 from the photoconductor 122.

Figure 2:
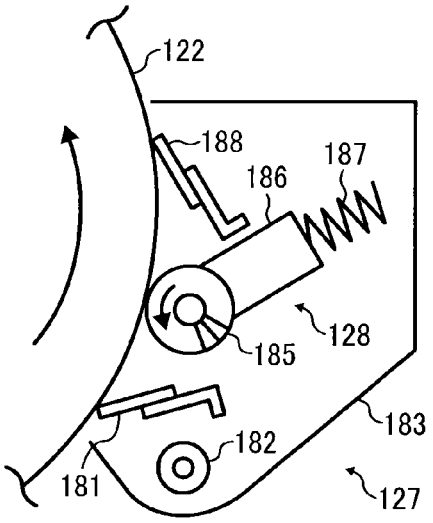
FIG. 2 is a schematic sectional view of a photoconductor cleaner incorporated in the image forming apparatus, illustrating a lubricant dispenser disposed in the photoconductor cleaner.

Referring now to FIG. 2, a detailed description is given of the photoconductor cleaner 127. FIG. 2 is a schematic sectional view of the photoconductor cleaner 127.

The photoconductor cleaner 127 removes residual toner (residual material) such as toner that fails to be transferred onto the intermediate transfer belt 143 and therefore remains on the surface of the photoconductor 122, after the discharger 126 discharges the surface of the photoconductor 122. It is to be noted that the residual toner includes, in addition to the toner that fails to be transferred onto the intermediate transfer belt 143, substances attached to the photoconductor 122 such as toner additives that is separated from the toner and attached to the photoconductor 122 and paper dust from a recording medium P attached to the photoconductor 122 via the intermediate transfer belt 143.

As illustrated in FIG. 2, the photoconductor 127 includes a photoconductor cleaning blade 181 and a collection roller 182 in a cleaning case 183. The photoconductor cleaning blade 181 contacts the surface of the photoconductor 122 in a counter direction to a rotational direction of the photoconductor 122, and removes residual toner from the surface of the photoconductor 122. The collection roller 182 conveys the residual toner thus removed to a collection container.

In the present embodiment, the photoconductor cleaner 127 also includes, in the cleaning case 183, a lubricant dispenser 128 that dispenses lubricant to the photoconductor 122.

The lubricant dispenser 128 includes, e.g., a brush 185, a solid lubricant 186, a spring 187, and a lubricant leveling blade 188. The brush 185 is disposed to contact the photoconductor 122 and the solid lubricant 186. The brush 185 is rotated in a direction opposite the rotational direction of the photoconductor 122 and scrapes the solid lubricant 186 pressed by the spring 187 to apply the solid lubricant 186 to the surface of the photoconductor 122. The lubricant leveling blade 188 is disposed downstream from a position at which the photoconductor 122 and the brush 185 face each other in the rotational direction of the photoconductor 122, and levels the lubricant applied to the surface of the photoconductor 122.

It is to be noted that, in the cleaning case 183, the photoconductor cleaning blade 181, the brush 185, and the lubricant leveling blade 188 are disposed in that order along the rotational direction of the photoconductor 122, to contact the photoconductor 122.

Referring back to FIG. 1, a detailed description is now given of the sheet feeder 13. The sheet feeder 13 supplies recording media P toward a contact area called a secondary transfer nip between a secondary transfer roller 145 and a secondary opposite roller 146.

Specifically, the sheet feeder 13 includes a tray 131, a sheet feeding roller 132, a sheet feeding belt 133, and a pair of registration rollers 134.

The tray 131 accommodates the recording media P.

The sheet feeding roller 132 rotates and moves the recording media P toward the sheet feeding belt 133 from the tray 131. More specifically, the sheet feeding roller 132 picks up an uppermost recording medium P of the recording media P accommodated in the tray 131 to place the recording medium P onto the sheet feeding belt 133.

The sheet feeding belt 133 conveys the recording medium P thus placed on the sheet feeding belt 133 toward the secondary transfer nip.

The pair of registration rollers 134 receives the recording medium P thus conveyed, and feeds the recording medium P to the secondary transfer nip so that the toner image is transferred onto the recording medium P from the intermediate transfer belt 143 at the secondary transfer nip.

The transfer unit 14 transfers toner images onto the intermediate transfer belt 143 from the photoconductors 122 in a primary transfer process so that the toner images are superimposed one atop another on the intermediate transfer belt 143, and then transfers the toner images together onto the recording medium P in a secondary transfer process.

Specifically, the transfer unit 14 includes, a drive roller 141, a driven roller 142, the intermediate transfer belt 143, five primary transfer rollers 144C, 144M, 144Y, 144K, and 144T facing the photoconductors 122C, 122M, 122Y, 122K, and 122T, respectively, the secondary transfer roller 145, and the secondary opposite roller 146.

The intermediate transfer belt 143 is an endless belt entrained around the drive roller 141, the driven roller 142, the secondary transfer roller 145, and the like. Rotation of the drive roller 141 rotates the intermediate transfer belt 143 in contact with the photoconductors 122, thereby rotating the driven roller 142.

While the intermediate transfer belt 143 is rotating in contact with the photoconductors 122, the toner images are transferred onto an outer circumferential surface of the intermediate transfer belt 143 from the photoconductors 122 at contact areas called primary transfer nips between the intermediate transfer belt 143 and the photoconductors 122.

The primary transfer rollers 144 face the respective photoconductors 122 via the intermediate transfer belt 143 and rotate to move the intermediate transfer belt 143.

The secondary transfer roller 145 rotates while sandwiching the intermediate transfer belt 143 and the recording medium P with the secondary opposite roller 146.

A detailed description is now given of the fixing device 15. After the toner image is transferred onto the recording medium P at the secondary transfer nip, the fixing device 15 fixes the toner image onto the recording medium P. Specifically, the fixing device 15 applies heat and pressure simultaneously to the toner, thereby melting and fixing resin components of the toner onto the recording medium P. Such fixing processing stabilizes the toner on the recording medium P.

The fixing device includes a conveyor belt 151, a fixing belt 152, a fixing roller 153, a fixing belt conveyor roller 154, a fixing opposite roller 155, and a heat generator 156.

After the toner image is transferred onto the recording medium P at the secondary transfer nip, the conveyor belt 151 conveys the recording medium P toward a contact area called a fixing nip between the fixing roller 153 and the fixing opposite roller 155.

The fixing belt 152 is entrained around the fixing roller 153 and the fixing belt conveyor roller 154, and rotated by rotation of the fixing roller 153 and the fixing belt conveyor roller 154.

The fixing roller 153 sandwiches the recording medium P conveyed by the conveyor belt 151 with the fixing opposite roller 155 disposed facing the fixing roller 153 at the fixing nip, where heat and pressure are applied to the recording medium P bearing the toner image.

The heat generator 156 is disposed inside the fixing roller 153, and generates heat to heat the recording medium P via the fixing roller 153.

A detailed description is now given of the ejection device 16. After the fixing device 15 fixes the toner image onto the recording medium P, the ejection device 16 ejects the recording medium P from the image forming apparatus 1. Specifically, the ejection device 16 includes an ejection belt 161, an ejection roller 162, an ejection port 163, and an ejection tray 164.

The ejection belt 161 conveys the recording medium P bearing the fixed toner image toward the ejection port 163.

The ejection roller 162 ejects the recording medium P thus conveyed by the ejection belt 161 through the ejection port 163 onto the ejection tray 164.

Thus, a plurality of recording media P rest one atop another on the ejection tray 164.

A detailed description is now given of the control panel 17. The control panel 17 includes a display part 171 and an operation part 172.

The display part 171 displays, e.g., settings and selection screens. The display part 171 is, e.g., a touchscreen through which instructions are inputted manually.

The operation part 172 includes, e.g., a numeric keypad through which image forming conditions are manually set and a start key to start a print job.

A description is now given of definitions of some terms and their units used in the following description for clarification. It is to be noted that the embodiments of the present invention are not limited to such definitions, but can be applied to configurations with different definitions without departing from the scope of the invention.

Imaging area S ($cm^2$) is an area in which a toner image can be formed on the photoconductor 122 corresponding to a recording medium P.

Image area ratio Sp (%) is a ratio of an area in which a toner image corresponding to an image to be formed on the recording medium P is formed to the imaging area S.

Adhering toner amount Td (mg/cm$^2$) is an amount of toner adhering to the photoconductor 122 per unit area in a developing process.

Toner input amount Tg (mg) is a total amount of toner adhering or inputted to the photoconductor 122 in the developing process, to form an image on the recording medium P.

Lubricant amount Ld (mg/cm$^2$) is an amount of lubricant that intervenes between the photoconductor 122 and the photoconductor cleaning blade 181 per unit area.

Lubricant application amount Lp (mg/s) is an amount of lubricant applied to the photoconductor 122 per unit of time by the lubricant dispenser 128.

Requisite application amount Ln (mg/s) is a requisite amount of lubricant applied to the photoconductor 122 per unit of time by the lubricant dispenser 128 according to the toner input amount Tg.

Now, a description is given of image forming apparatuses including comparative lubricant dispensers, before describing some embodiments of the present invention in detail. Typically, image forming apparatuses including a comparative lubricant dispenser that applies lubricant to an image bearer such as a photoconductor exhibit changes in the lubricant application amount Lp (mg/s) depending on the toner input amount Tg (mg).

For example, in image forming apparatuses having the same configuration as the image forming apparatus 1 described above, the lubricant amount Ld (mg/cm$^2$) intervening between a photoconductor and a photoconductor cleaning blade may decrease because the lubricant application amount Lp (mg/s) gradually decreases during continuous image formation on recording media P. Such a decrease may increase a friction coefficient between the photoconductor and the photoconductor cleaning blade, causing problems such as damage to surfaces of the photoconductor and the photoconductor cleaning blade, toner filming, and/or soil spots.

If the toner does not contain a lubricant component such as zinc stearate, the lubricant application amount Lp (mg/s) may decrease. Even if the toner contains a lubricant component, the lubricant application amount Lp (mg/s) may decrease in a configuration in which the lubricant application amount Lp (mg/s) depends on the lubricant dispenser.

Figure 3:
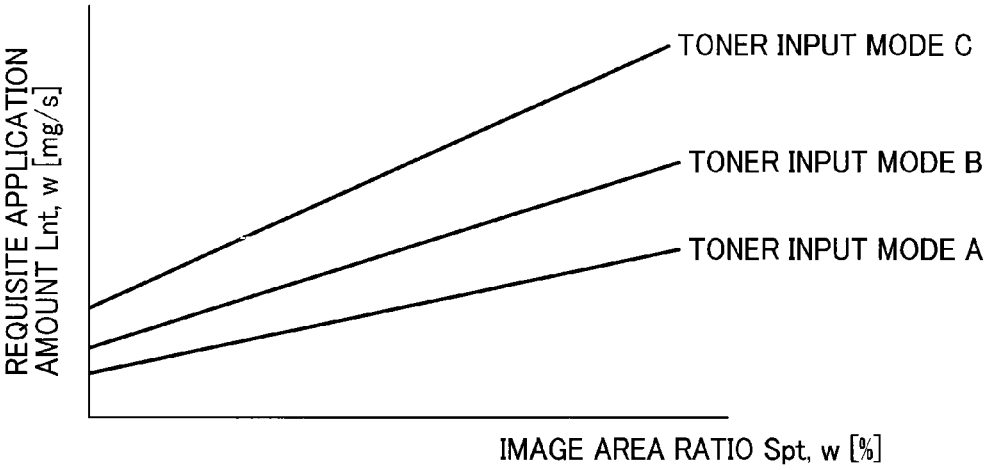
FIG. 3 is a graph illustrating a relation between requisite application amount and image area ratio of a photoconductor incorporated in the image forming apparatus by input mode of clear toner.

Although a detailed description is deferred with reference to FIG. 3, the inventors have found by, e.g., experiments that the requisite application amount Ln (mg/s) increases as the image area ratio Sp (%) increases. That is, continuous image formation with a relatively high image area ratio Sp (%), in other words, with a relatively large toner input amount Tg (mg), gradually decreases the lubricant application amount Lp (mg/s) despite an increase in the requisite application amount Ln (mg/s). As a result, the lubricant amount Ld (mg/cm$^2$) gradually decreases and may cause the above-described problems.

To prevent such problems, for example, an image forming apparatus is provided that employs a lubricant applying mode to drive a lubricant dispenser to apply lubricant to an image bearer such as a photoconductor while temporarily stopping attaching toner to the image bearer and driving the image bearer for a predetermined time (e.g., five seconds). During continuous image formation, the number of A4-size recording media bearing toner not smaller than a predetermined image area ratio (50%) is accumulated. The lubricant applying mode is executed when the accumulated number is equal to or exceeds a predetermined number. After execution of the lubricant applying mode, attachment of toner to the image bearer is resumed.

Such an image forming apparatus prevents the above-described problems, but increases an amount of lubricant removed from the image bearer by a cleaner immediately after execution of the lubricant applying mode, resulting in increased consumption of lubricant.

To prevent an increase of friction coefficient of the surface of the image bearer due to changes in the amount of lubricant applied to the image bearer, there are image forming apparatuses that have a brush roller that scrapes lubricant off a solid lubricant and applies the lubricant to an image bearer, and vary the number of rotations of the brush roller according to an image area ratio of a toner image adhering to the image bearer.

Specifically, the image forming apparatuses vary the number of rotations of the brush roller to be higher in response to a larger image area ratio in a configuration in which a friction coefficient of the surface of the image bearer increases because residual toner that fails to be transferred from the image bearer increases and shorten the amount of lubricant supplied to the image bearer.

Although this image forming apparatus prevents a friction coefficient increase, the number of rotations of the brush roller is excessively increased to absorb such changes in the lubricant application amount, thereby wasting the lubricant.

In a configuration in which a friction coefficient of the surface of the image bearer decreases in response to a relatively large image area ratio due to development using toner containing zinc stearate, the number of rotations of the brush roller is increased in response to a smaller image area ratio.

Although this configuration prevents a friction coefficient increase, the number of rotations of the brush roller is excessively increased to absorb changes in the lubricant application amount, thereby wasting the lubricant.

Such a problem that consumption of lubricant increases in an attempt to avoid problems arising from an insufficiency of applied lubricant may occur not only in image forming apparatuses including image forming devices employing process color toner such as yellow, magenta, cyan, and black toner, but also in image forming apparatuses including image forming devices employing spot color toner such as clear toner, white toner, and metal color toner, or in image forming apparatuses including an image forming device employing a single type of toner. Particularly, an image forming device employing a spot color toner attaches about three times as many amount of toner to an image bearer as an image forming device employing a process color toner.

Increased amount of toner attached to an image bearer may change the image area ratio during continuous image formation and vary an amount of lubricant applied to the image bearer, regardless whether or not the toner contains zinc stearate, or regardless of an amount of zinc stearate contained in the toner, if any. As a result, the frequency of executing the lubricant applying mode may be increased or the duration of the mode may be extended. Increased changes in the lubricant application amount to be absorbed may exhibit the above-described problems. Such problems may arise in image forming apparatuses including a belt latent image bearer such as a photoconductor belt or an intermediate transfer body such as an intermediate transfer belt to which lubricant is applied.

On the other hand, according to embodiments of the present invention, an image forming apparatus is provided that includes a lubricant dispenser that applies an efficient amount of lubricant to an image bearer while avoiding problems arising from an insufficiency of lubricant applied to the image bearer.

Such a lubricant dispenser (e.g., lubricant dispenser 128) is disposed in any of the image forming devices 120.

Accordingly, as a representative of the image forming devices 120, a description is given of the image forming device 120T according to an embodiment of the present invention, because in the image forming device 120T employing clear toner, consumption of lubricant may noticeably increase in an attempt to avoid problems arising from an insufficiency of applied lubricant.

It is to be noted that the image forming device 120T has the same configuration as the other image forming devices 120, differing only in the type of toner employed. Therefore, to simplify the description, the suffix "T" is omitted in the following description unless necessary. However, a suffix "t" that represents clear toner and a suffix "w" that represents white toner may be given after, e.g., image area ratio Sp as necessary.

As described above, the image forming device 120 includes the lubricant dispenser 128 to prevent such problems as damage to the photoconductor 122 and the photoconductor cleaning blade 181 and errors caused by residual toner that fails to be transferred from the photoconductor 122.

In the present embodiment, a spatial interval during image formation between successive recording media P is adjusted according to a toner input amount Tgt (mg), which is a total amount of toner adhering to the photoconductor 122T for each of the recording media P, when image formation is conducted on the successive recording media P. This result is achieved by the controller 10 adjusting, e.g., the timing of transport of a recording medium P with the pair of registration rollers 134, thereby adjusting (i.e., lengthening or shortening) the spatial interval during image formation between successive recording media P.

With such a configuration, little residual toner remains in an area of the photoconductor 122 corresponding to a spatial interval during image formation between successive recording media P that enter a lubricant applying position between the photoconductor 122 and the brush 185 of the lubricant dispenser 128 because clear toner used in a previous image forming process does not remain in the area. As a result, little new residual toner attaches to the brush 185 and the solid lubricant 186. Rotation of the brush 185 removes such new residual toner from the brush 185 and the solid lubricant 186, with existing residual toner that has been remaining on the brush 185 and the solid lubricant 186.

Accordingly, without adjusting operation of the brush 185 to increase a lubricant application amount Lpt (mg/s), which is an amount of lubricant applied to the photoconductor 122T per unit of time, lubricant is applied to the area of the photoconductor 122 in which little residual toner remains, while resuscitating lubricant applicability that has been reduced by residual toner on the brush 185 and the solid lubricant 186.

Accordingly, by adjusting the spatial interval during image formation between successive recording media P according to the toner input amount Tgt (mg), the lubricant is applied to the photoconductor 122 so that at least a requisite amount of lubricant intervenes between the photoconductor 122 and the photoconductor cleaning blade 181 while the photoconductor cleaning blade 181 slides on the photoconductor 122.

In other words, the lubricant is applied to the photoconductor 122 for each image forming process on a recording medium P so that the requisite amount of lubricant always intervenes between the photoconductor 122 and the photoconductor cleaning blade 181 to avoid problems arising, in the following image forming processes, from an insufficiency of applied lubricant. Thus, the lubricant is efficiently applied to the photoconductor 122 by preventing an increase in amount of lubricant removed from an image bearer by a cleaner immediately after execution of the lubricant applying mode.

Additionally, the lubricant application amount Lpt (mg/s) is stabilized because the lubricant is applied to the photoconductor 122 so that the requisite amount of lubricant always intervenes between the photoconductor 122 and the photoconductor cleaning blade 181 to avoid problems in the following image forming processes, without adjusting the operation of the brush 185. Accordingly, the lubricant is efficiently applied to the photoconductor 122 by preventing a waste of lubricant resulting from an excessive increase in the number of rotations of the brush roller to absorb changes in the lubricant application amount.

Thus, according to the embodiments of the present invention, an image forming apparatus (e.g., image forming apparatus 1) is provided that includes a lubricant dispenser (e.g., lubricant dispenser 128T) that applies an efficient amount of lubricant to an image bearer (e.g., photoconductor 122T) while avoiding problems arising from an insufficiency of lubricant applied (e.g., lubricant application amount Lpt (mg/s)) to the image bearer.

It is to be noted that the toner input amount Tgt (mg) of the clear toner is obtained by the following Equation 1:

$$Tgt = S \times Spt \times Tdt \qquad \text{Equation 1}$$

where "S" represents an imaging area ($cm^2$) of the photoconductor 122 corresponding to a recording medium P, "Spt" represents an image area ratio (%) of a toner image formed using the clear toner, and "Tdt" represents an amount ($mg/cm^2$) of clear toner adhering to the photoconductor 122.

It is to be noted that the toner input amount Tg (mg) of the process color toner is also obtained by Equation 1. The imaging area S ($cm^2$) is the same for all the photoconductors 122. Accordingly, the image area ratio Spt (%) of the toner image formed using the clear toner is based on image data processed and calculated by the controller 10. Similarly, image area ratios Spc, Spm, Spy, and Spk (%) of toner images formed using cyan, magenta, yellow, and black toner, respectively, are based on image data processed and calculated by the controller 10.

Referring to FIG. 3 through FIG. 8, a detailed description is now given of controlling (in productivity mode) the spatial interval during image formation between successive recording media P on which images are formed, by obtaining the appropriate spatial interval from the image area ratio Spt, w (%) (toner input amount Tgt, w (mg)) of the clear toner (white toner).

Figure 4:
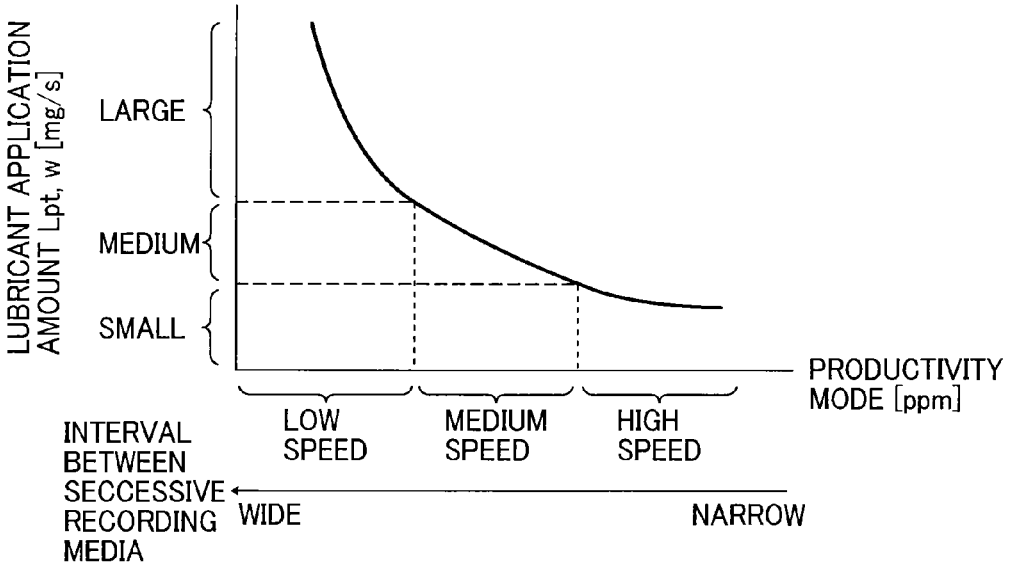
FIG. 4 is a graph illustrating a relation between lubricant application amount, productivity mode of the image forming apparatus, and spatial interval during image formation between successive recording media having a certain linear velocity.
Figure 5:
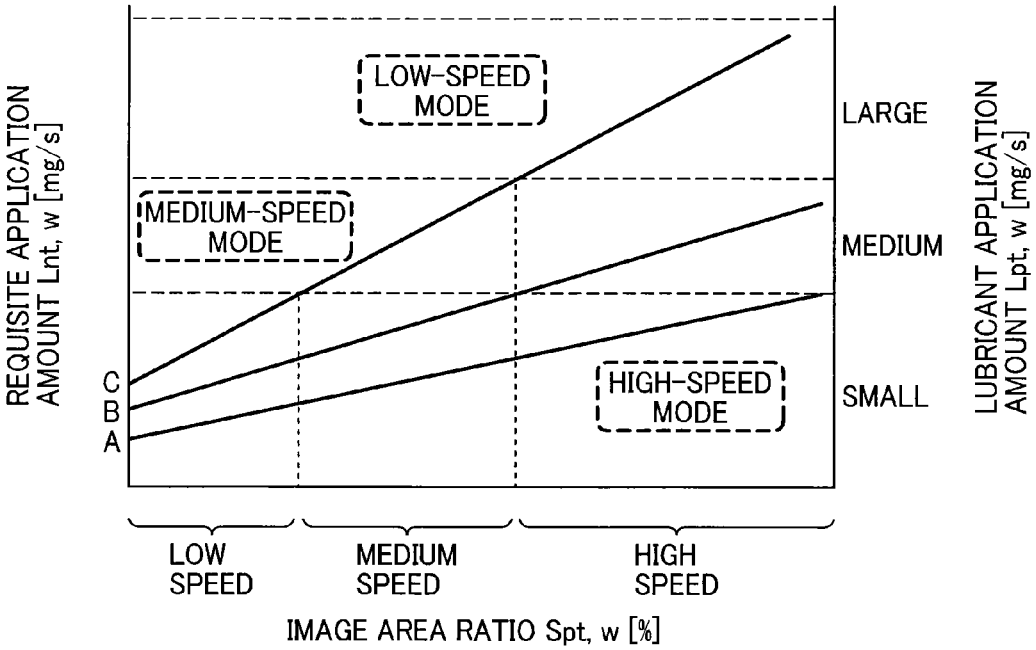
FIG. 5 is a combined graph of the relation between requisite application amount and image area ratio of the photoconductor by input mode of clear toner, and a relation between productivity mode of the image forming apparatus and lubricant application amount.
Figure 6:
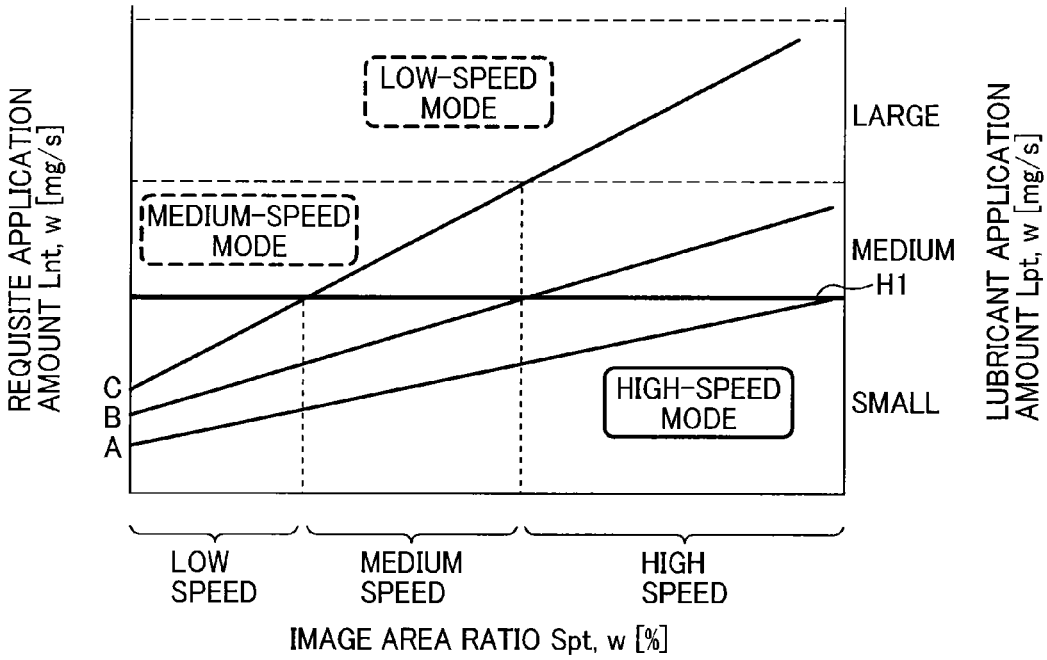
FIG. 6 is a graph illustrating selection of productivity mode and lubricant application amount in toner input mode A.
Figure 7:
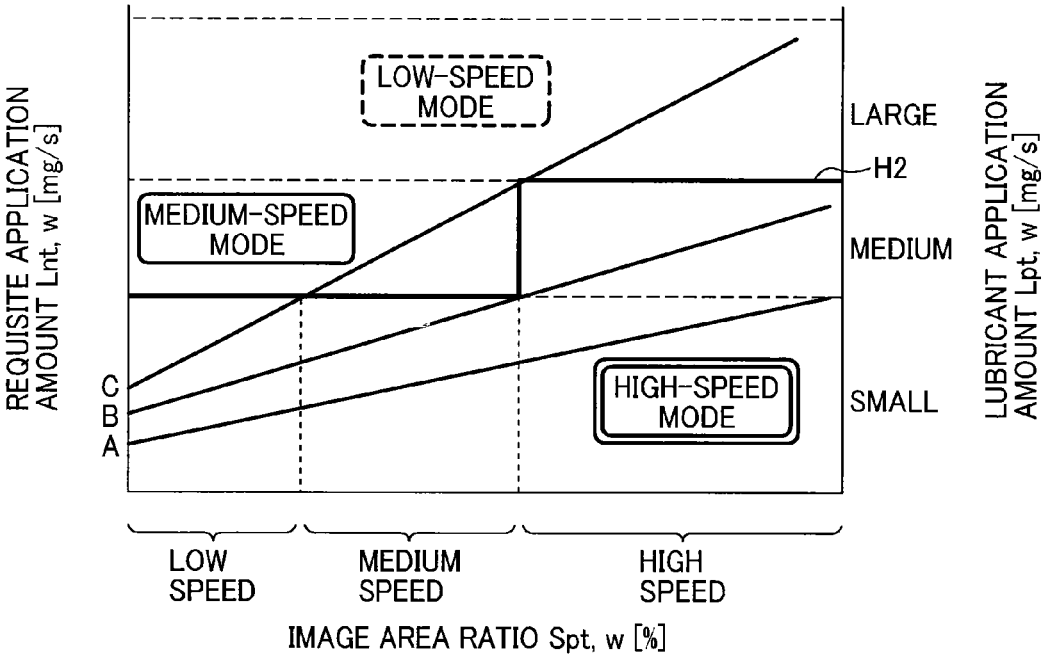
FIG. 7 is a graph illustrating selection of productivity mode and lubricant application amount in toner input mode B.
Figure 8:
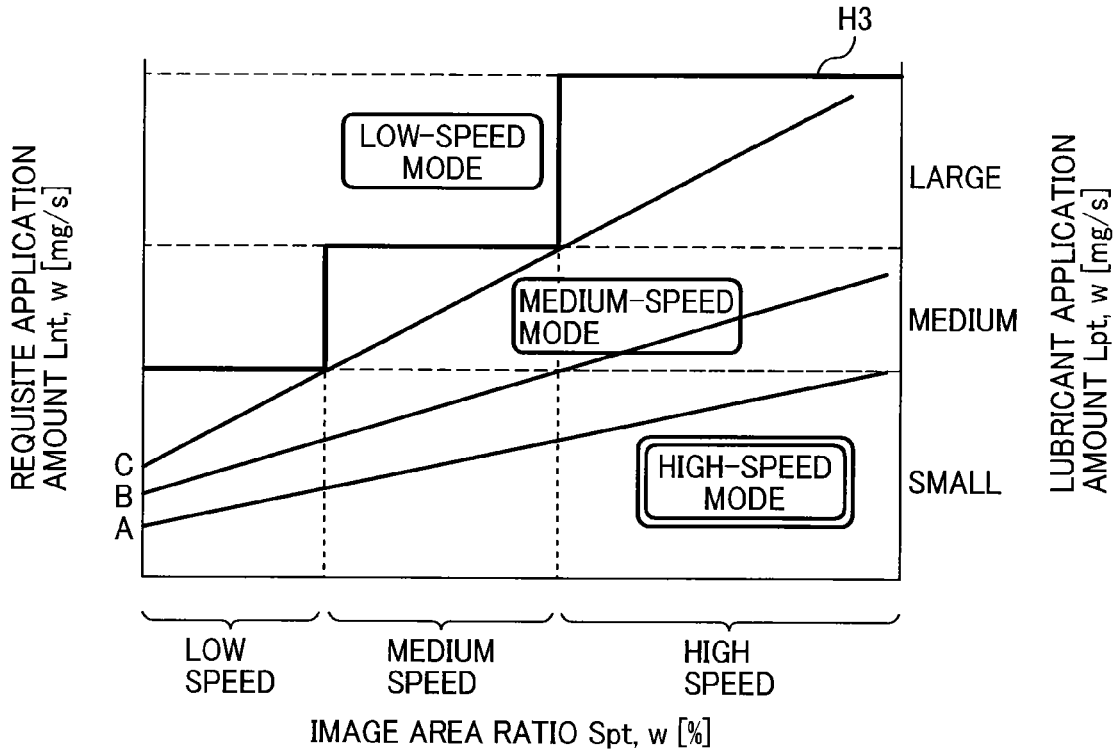
FIG. 8 is a graph illustrating selection of productivity mode and lubricant application amount in toner input mode C.

FIG. 3 is a graph illustrating a relation between requisite application amount Lnt, w and image area ratio Spt, w of the photoconductor 122 for each of input modes A, B, and C of the clear toner. FIG. 4 is a graph illustrating a relation between lubricant application amount Lpt, w, productivity mode of the image forming apparatus 1, and spatial interval during image formation between successive recording media P having a certain linear velocity on which toner images are transferred and thus formed. FIG. 5 is a combined graph of the relation between requisite application amount Lnt, w and image area ratio Spt, w of the photoconductor 122 for each of the toner input modes A, B, and C of the clear toner, and a relation between productivity mode of the image forming apparatus 1 and lubricant application amount Lpt, w. FIG. 6 is a graph illustrating selection of productively mode and lubricant application amount Lpt in toner input mode A. FIG. 7 is a graph illustrating selection of productively mode and lubricant application amount Lpw in toner input mode B. FIG. 8 is a graph illustrating selection of productively mode and lubricant application amount Lpw in toner input mode C.

The image forming apparatus 1 employs a toner input mode for each of the image forming devices 120 to determine an adhering toner amount Td (mg/cm$^2$), which is an amount of toner to attach to the photoconductor 122.

As described above, the image forming device 120T may contain white toner as spot color toner instead of clear toner in the developer container 121T. As shown in Table 1 below, a plurality of toner input modes, in this case three toner input modes A, B, and C, are specified.

TABLE 1

| TONER INPUT MODE | | |
|---|---|---|
| MODE | TONER TYPE | ADHERING TONER AMOUNT |
| A | CLEAR | MEDIUM |
| B | WHITE | MEDIUM |
| C | WHITE | HIGH |

In Table 1, in the present embodiment, the toner input modes are determined by two categories: toner type and adhering toner amount Tdt, w (mg/cm$^2$). Alternatively, the toner input modes may be determined by more than two categories.

Specifically, in Table 1, the toner input modes of spot color toner are determined by the type of spot color toner, such as clear toner and white toner, and adhering toner amount Tdt, w (mg/cm$^2$), which is the amount of toner adhering to the photoconductor 122T (photoconductor 122W) per unit area.

As shown in Table 1, the input modes B and C are determined by the same type of toner but by different adhering toner amounts per unit area. Even in such a case, according to the embodiments of the present invention, an efficient amount of lubricant is applied to the photoconductor 122T (photoconductor 122W) while avoiding problems arising from an insufficiency of lubricant applied to the photoconductor 122T (photoconductor 122W).

FIG. 3 shows the requisite application amount Lnt, w (mg/s) of lubricant with respect to the image area ratio Spt, w (%) obtained in advance by, e.g., experiments or simulation, for each of the toner input modes A, B, and C as specified in Table 1. For example, in FIG. 3, the requisite application amount Lnt, w (mg/s) is the highest in the toner input mode C because the toner input mode C is determined by the largest adhering toner amount Tdt, w (mg/cm$^2$) among the three toner input modes A, B, and C.

The controller 10 stores a "table of input and requisite amount", which includes the requisite application amount Lnt, w (mg/s) that changes by a relation between the image area ratio Spt, w (%) and the toner input modes A, B, and C determined by, e.g., the adhering toner amount Tdt, w (mg/cm$^2$).

With the "table of input and requisite amount", the toner input amount Tgt, w (mg) is calculated based on the image area ratio Spt, w (%) and the data of toner input modes A, B, and C. Additionally, the requisite application amount Lnt, w (mg/s), which is the amount of lubricant applied to the photoconductor 122, is calculated relative to the toner input amount Tgt, w (mg).

Accordingly, the spatial interval during image formation between successive recording media P is accurately adjusted by the controller 10 to a spatial interval where the requisite application amount Lnt, w (mg/s) of lubricant is applied according to the toner input modes A, B, and C.

By adjusting the spatial interval during image formation between successive recording media P, the productivity mode (PPM) is changed to obtain the lubricant application amount Lpt, w (mg/s) in advance. It is to be noted that the PPM stands for "pages per minute" and is a measurement of how fast (or how many pages) a printer is capable of printing per unit of time. For example, as the spatial interval during image formation between successive recording media P is gradually increased, the productivity of continuous print jobs decreases, and therefore, the lubricant application amount Lpt (mg/s) increases.

Specifically, as shown in FIG. 4, the productivity mode (PPM) is classified into three speed modes in advance: "high-speed mode"; "medium-speed mode"; and "low-speed mode". Similarly, the lubricant application amount Lpt, w (mg/s) is classified into three levels in advance: "large", "medium" and "small".

A relation between the productivity mode (PPM) and the lubricant application amount Lpt, w (mg/s) is obtained in advance and stored in the controller 10 as a "table of productivity and application amount".

The "table of productivity and application amount" allows calculation of the lubricant application amount Lpt, w (mg/s) in advance for each of the three speed modes of the productivity mode (PPM) that are switched when the spatial interval during image formation between successive recording media P is adjusted. Accordingly, lubricant is applied to the photoconductor 122 by switching the productivity mode (PPM) to a readily operable speed mode.

FIG. 5 is a graph of combined relations shown in the graphs of FIGS. 3 and 4. FIG. 5 shows the optimum requisite application amount Lnt, w (mg/s) based on the relation between the toner input modes A, B, and C and the predetermined three levels "low", "medium", and "high" of the image area ratio Spt, w (%), and therefore, FIG. 5 shows the lubricant application amount Lpt, w (mg/s) that satisfies the optimum requisite application amount Lnt, w (mg/s). As shown in FIG. 5, the productivity mode for spot color toner is determined as divided by heavy broken lines.

Specifically, the controller 10 stores a "table of input and application amount" for obtaining the lubricant application amount Lpt, w (mg/s) from the relation between the toner input amount Tgt, w (mg) and the requisite application amount Lnt, w (mg/s). Using the "table of input and application amount", an operable speed mode is selected from among the three speed modes of the productivity mode (PPM).

Thus, the lubricant application amount Lpt, w (mg/s) is obtained from the toner input amount Tgt, w (mg) and the requisite application amount Lnt, w (mg/s) to readily and reliably select an operable speed mode from among the three speed modes of the productivity mode (PPM).

Now, a description is given of specific examples.

In FIG. 6, operable productivity mode (PPM) with respect to the image area ratio Spt (%) is shown under a heavy line H1 in the toner input mode A, which is determined by clear toner and medium adhering toner amount Tdt (mg/cm$^2$). As the lubricant application amount Lpt, w (mg/s) is small, the operable productivity mode (PPM) remains in high-speed mode.

In FIG. 7, operable productivity mode (PPM) with respect to the image area ratio Spt (%) is shown under a heavy line H2 in the toner input mode B, which is determined by white toner and medium adhering toner amount Tdt (mg/cm$^2$). As the lubricant application amount Lpt, w (mg/s) is selected from small and medium amounts, the operable productivity mode (PPM) is high-speed mode or medium-speed mode.

In FIG. 8, operable productivity mode (PPM) with respect to the image area ratio Spt (%) is shown under a heavy line H3 in the toner input mode C, which is determined by white toner and large adhering toner amount Tdt (mg/cm$^2$). As the lubricant application amount Lpt, w (mg/s) is selected from small, medium, and large amounts, the operable productivity mode (PPM) is any speed mode.

Based on the relations shown in FIG. 6 through FIG. 8, optimum modes, operable but not optimum modes, and inoperable modes are shown in Table 2 below, where "X" represents an optimum mode, "Y" represents an operable but not optimum mode, and "Z" represents an inoperable mode.

TABLE 2

| TONER INPUT MODE | | | | PRODUCTIVITY MODE | | |
|---|---|---|---|---|---|---|
| MODE | TONER TYPE | AD-HERING TONER AMOUNT | IMAGE AREA RATIO | HIGH SPEED | MEDIUM SPEED | LOW SPEED |
| A | CLEAR | MEDIUM | LOW | X | Y | Y |
| | | | MEDIUM | | | |
| | | | HIGH | | | |
| B | WHITE | MEDIUM | LOW | X | Y | Y |
| | | | MEDIUM | | | |
| | | | HIGH | Z | X | Y |
| C | WHITE | HIGH | LOW | X | Y | Y |
| | | | MEDIUM | Z | X | Y |
| | | | HIGH | Z | Z | X |

Selection of the optimum mode, which provides maximum productivity of operable modes, indicated by "X" in Table 2 most efficiently prevents reduction in productivity of the image forming apparatus 1 resulting from adjustment of the spatial interval during image formation between successive recording media P.

On the other hand, selection of the operable but not optimum mode indicated by "Y" in Table 2 may reduce productivity of the image forming apparatus 1. However, the operable but not optimum mode is an option when the lubricant application amount Lpt, w (mg/s) is changed by, e.g., environmental changes and/or traveled distance. Alternatively, the operable but not optimum mode is an option when the spatial interval during image formation between successive recording media P is determined by, e.g., fixing conditions of the fixing device 15.

The above-described adjustment of the spatial interval during image formation between successive recording media P maintains a certain number of rotations of the brush 185 (i.e., linear velocity), and reduces fluctuation of the lubricant application amount Lpt, w (mg/s). Additionally, the productivity mode (PPM) is selected to change the lubricant application amount Lpt, w (mg/s) in synchronization with the change of toner input amount Tgt, w (mg).

The linear velocities of the photoconductor 122 and the intermediate transfer belt 143 are stabilized during continuous print jobs, thereby enhancing image quality that may be impaired by unstable linear velocities of endless components such as the photoconductor 122 and the intermediate transfer belt 143.

The above description is given of the image forming device 120T (or image forming device 120W) employing clear toner (or white toner) as spot color toner to which embodiments of the present invention are applied. Similarly, such embodiments are applicable to the image forming devices 120C, 120M, 120Y, and 120K employing process color toner.

According to the embodiments of the present invention, the image forming apparatus 1 applies an efficient amount of lubricant to the photoconductors 122 serving as image bearers as well as latent image bearers, while avoiding problems arising from an insufficiency of lubricant applied to the photoconductors 122.

As in the image forming apparatus 1, the spatial interval during image formation between successive recording media P is the same in an image forming apparatus that has a plurality of (latent) image bearers (e.g., photoconductors).

In the image forming apparatus 1, a largest spatial interval during image formation between successive recording media P is selected from among spatial intervals obtained individually for the photoconductors 122 to form images on the successive recording media P. In other words, a productivity mode is selected to ensure the largest spatial interval among productivity modes obtained individually for the photoconductors 122.

Accordingly, such an image forming apparatus that includes a plurality of photoconductors applies an efficient amount of lubricant to the photoconductors while avoiding problems arising from an insufficiency of lubricant applied to the photoconductors.

As described above, the image forming apparatus 1 includes the photoconductors 122C, 122M, 122Y, and 122K on which process color toner images are formed, and the photoconductor 122T on which a clear toner image is formed as a spot color toner image. The photoconductor 122T may be referred to as a photoconductor 122W when white toner is used instead of clear toner as spot color toner and a white toner image is formed on the photoconductor 122W. In such an image forming apparatus that includes at least one photoconductor on which a clear spot color toner image is formed, in addition to at least one photoconductor on which a process color toner is formed, and therefore may face problems arising from an insufficiency of lubricant application amount Lp (mg/s), an efficient amount of lubricant is applied to the photoconductors while avoiding problems arising from an insufficiency of lubricant applied to the photoconductors.

In the image forming apparatus 1, the lubricant applied to the photoconductors 122 by the respective lubricant dispensers 128 is further supplied between the intermediate transfer belt 143 and a cleaning blade for the intermediate transfer belt 143 in requisite amount, thereby obviating the need to provide a separate lubricant dispenser to apply lubricant to the intermediate transfer belt 143.

The embodiments of the present invention are not limited to such a configuration, but are applicable to an image forming apparatus that includes a lubricant dispenser to apply lubricant to an intermediate transfer body serving as an image bearer onto which a toner image is transferred from a latent image bearer.

According to the embodiments of the present invention, such an image forming apparatus applies an efficient amount of lubricant to the intermediate transfer body while avoiding problems arising from an insufficiency of lubricant applied to the intermediate transfer body.

It is to be noted that a productivity mode is selected to ensure a largest spatial interval during image formation between successive recording media among productivity modes obtained individually for the latent image bearer and the intermediate transfer body serving as image bearers.

As described above, the developer container 121T includes the toner bottle of clear toner that is replaceable with another toner bottle of another spot color toner. However, the embodiments of the present invention are not limited to such a configuration.

For example, the embodiments of the present invention are applicable to an image forming apparatus that includes a plurality of developer containers, each of which includes a replaceable toner bottle between one of process color toner and one of spot color toner.

The embodiments of the present invention are also applicable to an image forming apparatus that includes a single image forming device, such as a monochrome image forming apparatus.

Although specific embodiments are described, the configuration of the image forming apparatus according to this patent specification is not limited to those specifically described herein. Several aspects of the image forming apparatus are exemplified as follows.

According to a first aspect, an image forming apparatus (e.g., image forming apparatus 1) includes a first image bearer (e.g., photoconductor 122), a lubricant dispenser (e.g., lubricant dispenser 128) to apply lubricant (e.g., solid lubricant 186) to the first image bearer, and a controller (e.g., controller 10) to adjust a spatial interval during image formation between successive recording media (e.g., recording media P) on each of which an image is formed, according to a total amount of toner (e.g., clear toner) attached to the first image bearer (e.g., toner input amount Tgt (mg)) for each of the successive recording media, to apply the lubricant to the first image bearer.

Such an image forming apparatus has advantages as described below.

Little residual toner remains in an area of the first image bearer corresponding to the spatial interval during image formation between the successive recording media that enter a lubricant applying position between the first image bearer and an applicator (e.g., brush 185) of the lubricant dispenser because toner used in a previous image forming process does not remain in the area. As a result, little new residual toner attaches to the applicator and the lubricant. Rotation of the applicator removes such new residual toner from the applicator and the lubricant, with existing residual toner that has been remaining on the applicator and the lubricant.

Accordingly, without adjusting operation of the applicator to increase an amount of the lubricant applied to the first image bearer per unit of time (e.g., lubricant application amount Lpt (mg/s)), the lubricant is applied to the area of the first image bearer in which little residual toner remains, while resuscitating lubricant applicability of the applicator.

Accordingly, by adjusting the spatial interval during image formation between the successive recording media according to the total amount of toner attached to the first image bearer, the lubricant is applied to the first image bearer so that at least a requisite amount of lubricant intervenes between the first image bearer and a cleaner (e.g., photoconductor cleaning blade 181) while the cleaner slides on the first image bearer.

In other words, the lubricant is applied to the first image bearer for each image forming process on a recording medium so that the requisite amount of lubricant always intervenes between the first image bearer and the cleaner to avoid problems arising, in the following image forming processes, from an insufficiency of applied lubricant. Thus, the lubricant is efficiently applied to the first image bearer by preventing an increase in amount of lubricant removed from the first image bearer by the cleaner immediately after execution of a lubricant applying mode.

Additionally, the amount of the lubricant applied to the first image bearer per unit of time is stabilized because the lubricant is applied to the first image bearer so that at least the requisite amount of lubricant always intervenes between the first image bearer and the cleaner to avoid problems in the following image forming processes, without adjusting the operation of the applicator. Accordingly, the lubricant is efficiently applied to the first image bearer by preventing a waste of lubricant resulting from an excessive increase in the number of rotations of the applicator to absorb changes in the lubricant application amount.

Thus, the image forming apparatus that includes the lubricant dispenser applies an efficient amount of lubricant to the first image bearer while avoiding problems arising from an insufficiency of lubricant applied to the first image bearer.

According to a second aspect, the controller stores a first table (e.g., table of input and requisite amount) that includes a requisite amount of the lubricant applied to the first image bearer per unit of time (e.g., requisite application amount Lnt, w (mg/s)) that changes by a relation between a toner image area ratio on the first image bearer (e.g., image area ratio Spt, w (%)) and a toner input mode (e.g., toner input modes A, B, and C) determined by an amount of toner attached to the first image bearer per unit area (e.g., adhering toner amount Tdt, w ($mg/cm^2$)).

Accordingly, in advance, the total amount of toner attached to the first image bearer is calculated based on the image area ratio and the toner input mode, to further calculate the requisite application amount relative to the total amount of toner attached to the first image bearer.

As a result, the spatial interval during image formation between the successive recording media is accurately adjusted by the controller to a spatial interval where the requisite amount of the lubricant is applied to the first image bearer according to the toner input mode.

According to a third aspect, the controller stores a second table (e.g., table of productivity and application amount) that includes an amount of the lubricant applied to the first image bearer per unit of time (e.g., lubricant application amount Lpt, w (mg/s)) obtained by adjusting the spatial interval during image formation between the successive recording media to switch speed modes (e.g., high-speed mode, medium-speed mode, and low-speed mode) of a productivity mode (PPM) for determining how many pages to print per unit of time.

Accordingly, the amount of the lubricant applied to the first image bearer per unit of time is calculated in advance for each of the speed modes of the productivity mode that are switched when the spatial interval during image formation between the successive recording media is adjusted. As a result, the lubricant is applied to the first image bearer by switching the productivity mode to a readily operable speed mode.

According to a fourth aspect, in the image forming apparatus according to the third aspect, the controller further stores a third table (e.g., table of input and application amount) for obtaining the amount of the lubricant applied to the first image bearer per unit of time from a relation between the total amount of toner attached to the first image bearer and the requisite amount of the lubricant applied to the first image bearer, and selects one or more operable speed modes from among the speed modes of the productivity mode.

Accordingly, the amount of the lubricant applied to the first image bearer per unit of time is obtained from the total amount of toner attached to the first image bearer and the requisite amount of the lubricant applied to the first image bearer per unit of time, to readily and reliably select one or more operable speed modes from among the speed modes of the productivity mode.

According to a fifth aspect, in the image forming apparatus according to the fourth aspect, the controller selects a speed mode for the image forming apparatus that provides maximum productivity from among the one or more operable speed modes of the productivity mode, thereby most efficiently preventing reduction in productivity resulting from adjustment of the spatial interval during image formation between the successive recording media.

According to a sixth aspect, the first image bearer includes a latent image bearer (e.g., photoconductor 122).

Accordingly, an efficient amount of lubricant is applied to the latent image bearer while avoiding problems arising from an insufficiency of lubricant applied to the latent image bearer.

According to a seventh aspect, the image forming apparatus further includes a latent image bearer (e.g., photoconductor 122) on which a toner image is formed. The first image bearer includes an intermediate transfer body (e.g., intermediate transfer belt 143) onto which the toner image is transferred from the latent image bearer.

Accordingly, an efficient amount of lubricant is applied to the intermediate transfer body while avoiding problems arising from an insufficiency of lubricant applied to the intermediate transfer body.

According to an eighth aspect, the image forming apparatus further includes a second image bearer. The controller determines a largest spatial interval during image formation between the successive recording media among spatial intervals obtained individually for the first image bearer and the second image bearer.

Accordingly, such an image forming apparatus including a plurality of image bearers applies an efficient amount of lubricant to the image bearers while avoiding problems arising from an insufficiency of lubricant applied to the image bearers (e.g., lubricant application amount Lp (mg/s)).

According to a ninth aspect, in the image forming apparatus according to the eighth aspect, the first image bearer includes a first latent image bearer (e.g., photoconductor 122T or 122W) on which a spot color toner (e.g., clear toner or white toner) is formed, and the second image bearer includes a second latent image bearer (e.g., photoconductor 122C, 122M, 122Y, or 122K) on which a process color toner (e.g., cyan, magenta, yellow, or black) image is formed.

Accordingly, in such an image forming apparatus that may face problems arising from an insufficiency of amount of lubricant applied to the first and second image bearers, especially to the first image bearer on which a spot color toner is formed, an efficient amount of lubricant is applied to the first and second image bearers while avoiding problems arising from an insufficiency of lubricant applied to the first and second image bearers.

According to a tenth aspect, in the image forming apparatus according to the ninth aspect, a toner input mode of the spot color toner (e.g., clear toner or white toner) is determined by a type of the spot color toner and an amount of the spot color toner attached to the first image bearer per unit area.

Accordingly, different toner input modes may be determined by the same type of the spot color toner and different amounts of the spot color toner attached to the first image bearer per unit area. Even in such a case, an efficient amount of lubricant is applied to the first image bearer (e.g., photoconductor 122T (photoconductor 122W)) while avoiding problems arising from an insufficiency of lubricant applied to the first image bearer.

According to an eleventh aspect, the image forming apparatus according to the eighth aspect further includes a first latent image bearer (e.g., photoconductor 122T or 122W) on which a spot color toner (e.g., clear toner or white toner) is formed, and a second latent image bearer (e.g., photoconductor 122C, 122M, 122Y, or 122K) on which a process color toner (e.g., cyan, magenta, yellow, or black) image is formed.

Accordingly, in such an image forming apparatus that may face problems arising from an insufficiency of amount of lubricant applied to the first and second latent image bearers, especially to the first latent image bearer on which a spot color toner is formed, an efficient amount of lubricant is applied to the first and second latent image bearers while avoiding problems arising from an insufficiency of lubricant applied to the first and second latent image bearers.

According to a twelfth aspect, in the image forming apparatus according to the eleventh aspect, a toner input mode of the spot color toner (e.g., clear toner or white toner) is determined by a type of the spot color toner and an amount of the spot color toner attached to the first latent image bearer per unit area.

Accordingly, different toner input modes may be determined by the same type of the spot color toner and different amounts of the spot color toner attached to the first latent image bearer per unit area. Even in such a case, an efficient amount of lubricant is applied to the first latent image bearer (e.g., photoconductor 122T (photoconductor 122W)) while avoiding problems arising from an insufficiency of lubricant applied to the first latent image bearer.

Numerous additional modifications and variations are possible in light of the above teachings. It is therefore to be understood that within the scope of the appended claims, the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of the present invention and appended claims.

Further, any of the above-described devices or units can be implemented as a hardware apparatus, such as a special-purpose circuit or device, or as a hardware/software combination, such as a processor executing a software program.

What is claimed is:

1. An image forming apparatus comprising:

a first image bearer;

a lubricant dispenser to apply lubricant to the first image bearer; and a controller to adjust a spatial interval during image formation between successive recording media on each of which an image is formed, according to a total amount of toner attached to the first image bearer for each of the successive recording media, to apply the lubricant to the first image bearer.

2. The image forming apparatus according to claim 1, wherein the controller stores a first table that includes a requisite amount of the lubricant applied to the first image bearer per unit of time that changes by a relation between a toner image area ratio on the first image bearer and a toner input mode determined by an amount of toner attached to the first image bearer per unit area.

3. The image forming apparatus according to claim 1, wherein the controller stores a second table that includes an amount of the lubricant applied to the first image bearer per unit of time obtained by adjusting the spatial interval during image formation between the successive recording media to switch speed modes of a productivity mode for determining how many pages to print per unit of time.

4. The image forming apparatus according to claim 3, wherein the controller further stores a third table for obtaining the amount of the lubricant applied to the first image bearer per unit of time from a relation between the total amount of toner attached to the first image bearer and the requisite amount of the lubricant applied to the first image bearer per unit of time, and selects one or more operable speed modes from among the speed modes of the productivity mode.

5. The image forming apparatus according to claim 4, wherein the controller selects a speed mode for the image forming apparatus that provides maximum productivity from among the one or more operable speed modes of the productivity mode.

6. The image forming apparatus according to claim 1, wherein the first image bearer comprises a latent image bearer.

7. The image forming apparatus according to claim 1, further comprising a latent image bearer on which a toner image is formed, wherein the first image bearer comprises an intermediate transfer body onto which the toner image is transferred from the latent image bearer.

8. The image forming apparatus according to claim 1, further comprising a second image bearer, wherein the controller determines a largest spatial interval during image formation between the successive recording media among spatial intervals obtained individually for the first image bearer and the second image bearer.

9. The image forming apparatus according to claim 8, wherein the first image bearer comprises a first latent image bearer on which a spot color toner image is formed, and the second image bearer comprises a second latent image bearer on which a process color toner image is formed.

10. The image forming apparatus according to claim 9, wherein a toner input mode of the spot color toner is determined by a type of the spot color toner and an amount of the spot color toner attached to the first image bearer per unit area.

11. The image forming apparatus according to claim 8, further comprising:

a first latent image bearer on which a spot color toner image is formed; and a second latent image bearer on which a process color toner image is formed.

12. The image forming apparatus according to claim 11, wherein a toner input mode of the spot color toner is determined by a type of the spot color toner and an amount of the spot color toner attached to the first latent image bearer per unit area.

13. The image forming apparatus according to claim 1, wherein the spatial interval is adjusted according to a toner input amount, which is a total amount of toner adhering to the photoconductor for each of the recording media.

14. The image forming apparatus according to claim 1, further comprising a pair of registration rollers that receive the recording media and feeds the recording media to a secondary transfer nip to transfer a toner image, wherein the controller lengthens or shortens the spatial interval with the pair of registration rollers.

15. The image forming apparatus according to claim 1, further comprising a charger the charges the first image bearer during the spatial interval.

* * * * *